United States Patent [19]

Potter et al.

[11] 4,109,948

[45] Aug. 29, 1978

[54] PLASTIC LATCH BOLT FOR DOOR LOCK

[75] Inventors: Dennis G. Potter; Hagen Dietrich, both of Delta; Joseph Potschka, Vancouver, all of Canada

[73] Assignee: Norris Industries, South Gate, Calif.

[21] Appl. No.: 712,896

[22] Filed: Aug. 9, 1976

Related U.S. Application Data

[63] Continuation-in-part of Ser. No. 712,898, Aug. 9, 1976, abandoned.

[51] Int. Cl.[2] ..... E05B 3/08; E05C 1/12

[52] U.S. Cl. ..... 292/169.15; 292/336.5; 292/DIG. 38

[58] Field of Search ..... 292/163, 169.14, 169.15, 292/169.16, 169.17, 169.18, 169.19, 169.21, 169.22, 169.23, 336.3, 336.5, 347, 348, 349, 350, 351, 352, 353, 354, 355, 356, 357, 358, 359, DIG. 38, DIG. 53, DIG. 61

[56] References Cited

U.S. PATENT DOCUMENTS

| | | | |
|---|---|---|---|
| 640,984 | 1/1900 | Anderson | 292/169.15 |
| 3,038,747 | 6/1962 | Rapata | 292/DIG. 38 |
| 3,105,712 | 10/1963 | Duvall | 292/169.17 |
| 3,186,747 | 6/1965 | Hamm et al. | 292/169.17 X |
| 3,253,848 | 5/1966 | Wilson | 292/169 UX |
| 3,724,888 | 4/1973 | James | 292/DIG. 38 |
| 3,825,289 | 7/1974 | Armstrong | 292/DIG. 38 X |

FOREIGN PATENT DOCUMENTS

| | | | |
|---|---|---|---|
| 955,978 | 6/1972 | Canada | 292/DIG. 38 |
| 2,529,850 | 1/1976 | Fed. Rep. of Germany | 292/DIG. 38 |

*Primary Examiner*—Roy D. Frazier
*Assistant Examiner*—Thomas J. Holko

[57] ABSTRACT

A plastic door lock makes use of moldable plastic material for most of the individual parts with opposite roses adapted to interlock with each other and be held together with a single screw on the axial center line of the knobs and accessible from the outside. A lost motion connection between the latch bolt and spindle allows the door to be closed without damage to the latch bolt when the inside knob is locked. Inherent resiliency in the material of the latch bolt case formed into spring fingers, in cooperation with the movable latch bolt shaft, releasably returns the latch bolt shaft to, and holds the shaft in extended position. Under some circumstances spring action of the fingers is supplemented with an auxiliary separate spring element to vary the spring return characteristics of the latch bolt and the knobs.

13 Claims, 17 Drawing Figures

PLASTIC LATCH BOLT FOR DOOR LOCK

This is a continuation-in-part of copending application Ser. No. 712,898 Dated Aug. 9, 1976, and now abandoned.

Although there has recently been great stress laid upon the security feature of locks there are sundry types of installations where security is not of primary consequence. Despite the lack of stress on the security feature, locks for such purpose do need to be dependable, namely to open and close when needed, in a reliable fashion, for long periods of use. Some installations also have need for what is commonly known as a privacy lock, namely one which can be locked or blocked on the inside for temporary security but which can be released from the outside, in case of an emergency, by some conventional tool such as a screw driver or ice pick, for example. Installations of the type suggested are often adequately supplied by locks of less costly construction and where installations can be quickly and easily made by persons of no more than modest skill. Areas where such locks are in demand include interior doors of recreation vehicles, campers, trailers, temporary housing, closet doors and the like where a door needs to be shut and held shut but wherein no attempt is made to provide a lock greatly resistant to tempering and unauthorized entry.

With the advent of dependable synthetic plastic resin material there has been a progressive substitution of the plastic resin material for some of the working parts of locks. By proper design more and more of the metallic components of a lock can be dispensed with in favor of plastic components. The fact remains, however, that plastic material does have limitations in that it cannot be made in sections as thin as metallic material and on other occasions falls short of the strength which might be required. Moreover if full advantage is to be taken of the use of plastic material it is important to minimize the number of separate components without sacrificing the number of functions performed by each so that such a lock made substantially of plastic components can be molded of relatively few parts and sold in great quantities therefore at an acceptable price advantage.

It is therefore among the objects of the invention to provide a new and improved substantially all plastic lock which is simple, dependable and relatively inexpensive and which at the same time functions smoothly and with a sufficient degree of security to be a useful locking expedient.

Another object of the invention is to provide a new and improved substantially all plastic lock wherein spring means for returning a latch bolt to extended lateral position is inherently built into the plastic parts making up the latch bolt subassembly.

Another object of the invention is to provide a new and improved substantially all plastic lock which includes a plastic latch bolt sub-assembly consisting of a relatively minimum number of individual parts, easily and quickly assembled together and inserted into place in the door in cooperation with the knobs.

Still another object of the invention is to provide a new and improved lock of substantially all plastic components wherein the number of components is kept substantially to a minimum by reason of building into the main components as integral parts, those parts which normally have existed as separate independent components.

Still another object of the invention is to provide a new and improved lock of substantially all plastic components wherein a metallic spring for returning the latch bolt to extended position has been dispensed with in favor of a new and improved plastic return mechanism with virtually a minimum number of individual separate components.

Still another object of the invention is to so construct the latch bolt of plastic material that the resiliency of the material serves to extend the latch bolt and also to return the knobs to initial position, the spring structure being such that it can be varied by provision of a single piece auxiliary spring.

Also included among the objects of the invention is to provide a new and inproved latch bolt structure built primarily of molded plastic resin material in such a combination that the spring action of the latch bolt can be adjusted to serve as a positive return for locks to initial position as well as return the latch bolt itself to extended position.

With these and other objects in view, the invention consists of the construction, arrangement and combination of the various parts of the device, whereby the objects contemplated are attained, as hereinafter set forth, pointed out in the appended claims and illustrated in the accompanying drawings.

Figures 1, 2:
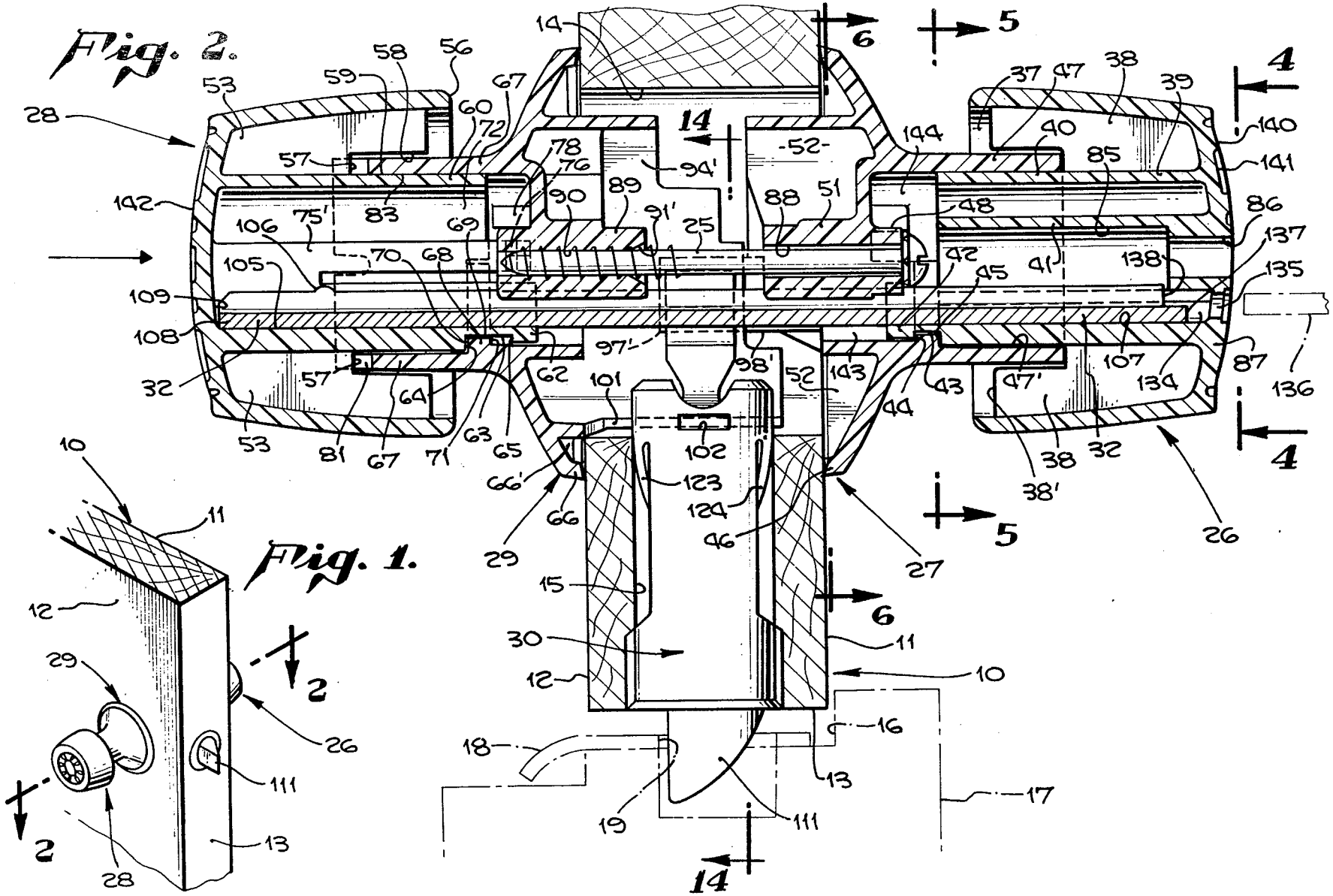
FIG. 1 is a fragmentary perspective view of a section of door showing the plastic privacy lock installed.
FIG. 2 is a longitudinal sectional view on the line 2—2 of FIG. 1.

In an embodiment of the invention chosen for the purpose of illustration, a lock is shown in FIGS. 1 and 2 installed on a door 10 which has an outside face 11, an inside face 12 and a side edge or edge face 13. An opening 14 extends through the door between the outside and inside faces. A bore 15 extends from the edge face 13 into the opening 14. The door 10 is adapted to swing against a door stop 16 in a door frame 17, the frame being provided with a conventional strike plate 18 having the customary latch bolt opening 19 in it. The parts described up to this point are found or virtually all types of doors in which the door lock of the invention is installed.

Figure 3:
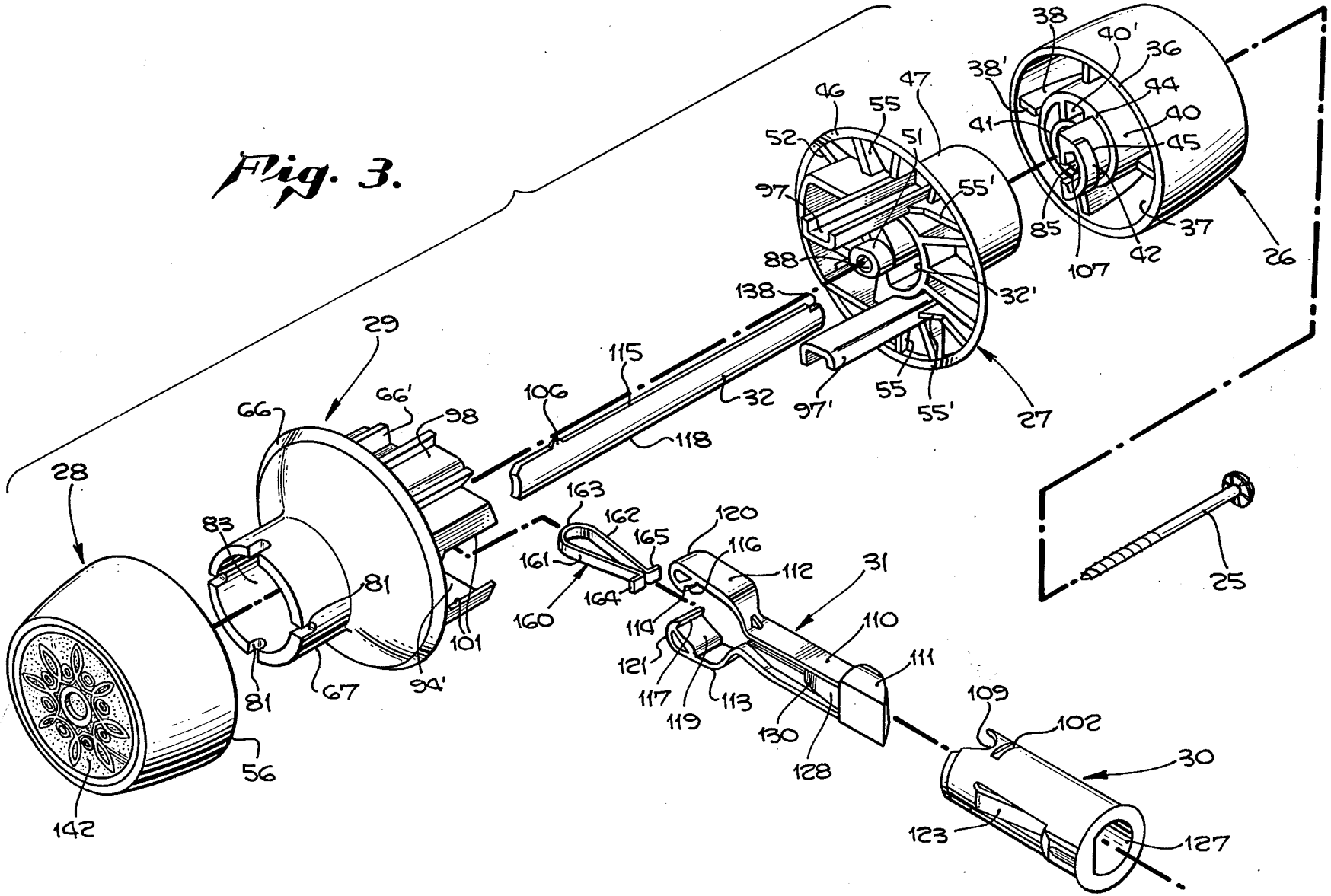
FIG. 3 is an exploded perspective view of all the individual parts.
Figure 5:
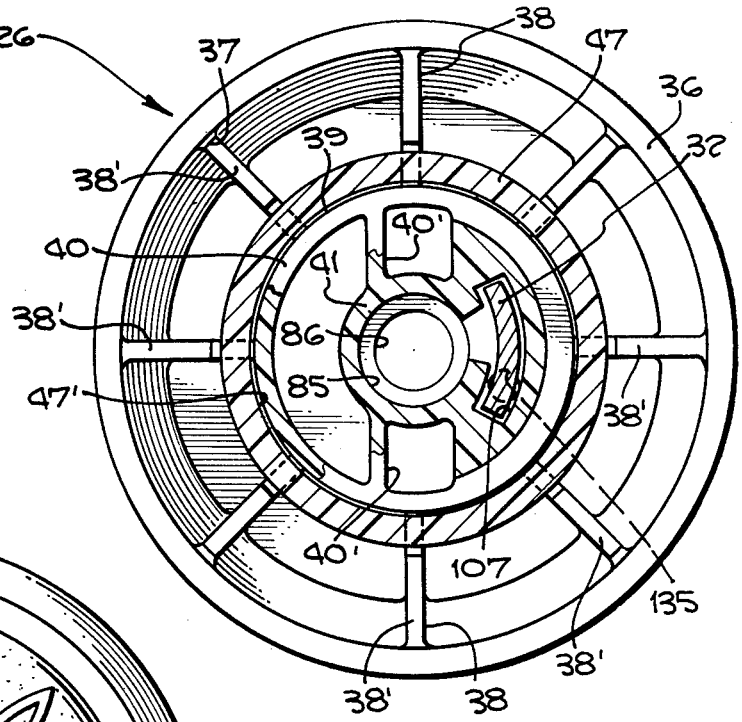
FIG. 5 is a cross-sectional view on the line 5—5 of FIG. 2.

In the illustration embodiment there are seven parts for the door latch all of which are individually shown in FIG. 3 together with a conventional mounting screw 25. All parts of the latch are of a synthetic plastic resin material except for the spindle 32 and the mounting screw 25 which, in the present embodiment are of metal. An outside sub-assembly consists of an outside knob 26 and outside rose or mounting plate 27. An inside sub-assembly consists of an inside knob 28 and inside rose or mounting plate 29. A latch bolt assembly consists of a case 30 and latch bolt 31. All parts of the sub-assemblies just described are constructed of an appropriate synthetic plastic resin. Cooperating with the outside and inside sub-assemblies is a spindle 32 which is preferably metal but which can be of an appropriate plastic material.

As shown in FIGS. 2, 3, 4, and 5 the outside knob 26 has an inside end 36 in which is an annular recess 37 formed by inner ends 38' of fins 38 and the wall 39 of a sleeve-like protruberance 40. The protruberance 40 stiffened by fins 40' extends axially inwardly of the inside face 36. Concentrically disposed within the protruberance 40 is an inner sleeve 41, at the inner end of which is an arcuate projection 42 separated from the remainder of the inner sleeve 41 by a recess 43. The recess forms an outwardly facing shoulder 44 and an inwardly facing shoulder 45. By reason of the character of the material and the length of the inner sleeve there is a degree of flexibility.

The outside rose 27 has an annular rim 46 which may be pitched slightly inwardly so that its outside edge may bite slightly into the outside face 11 of the door. Extending axially outwardly from the rim is a bearing sleeve 47 having an inside bearing surface 47'. The bearing sleeve extends into the recess 37 where the wall 39 on the protruberance 40 is adapted to bear as the knob is rotated relative to the rose. A boss 48 is an extension of a centrally disposed mass 51 molded integrally with the rose 27 to which the mass is attached by sundry radially disposed fins 52 and associated fins 55, 55'. The mass 51 and portions of the fins 52 project inwardly relative to the outside face 11 of the door. An enlarged arcuate clearance 32' in the outside rose provides room for the spindle to rotate.

Extending inwardly into the inside knob 28 from an inside end 56 is a series of recesses 57 each formed by a wall 58 of a fin 53 and the exterior of a somewhat sleeve-like protruberance 60. Alternate fins 54 are cut deeper. At the inner end of the protruberance 60 is an arcuate projection 62. The projection is separated from the remainder of the protruberance by a relatively wide recess 63 which provides an outwardly facing shoulder 64 and an inwardly facing shoulder 65.

On the inside rose 29 is an annular rim 66 which is adapted to bear against the inside face 12 of the door. This rim also may be pitched slightly inwardly so that its outside edge may bite slightly into the face 12 of the door and ensure contact of the rim structure 66' also with the face of the door. Extending axially outwardly from the inside rose 29 is a bearing sleeve 67 which projects deeply into the recess 57 of the inside knob 28 to a position where it is adapted to bear rotatably against the wall 59. An arcuate boss 68 provides an arcuate surface 69 in a position adapted to bear against the bottom of the recess 63 and also to provide an axially outwardly facing shoulder 70 adapted to engage the inwardly facing shoulder 64 of the knob. An axially inwardly facing shoulder 71 is adapted to engage the outwardly facing shoulder 65 of the inside knob. As will be observed from the drawings, particularly FIGS. 2 and 7, the width of the recess 63 is substantially greater than the width of the boss 68 so that the inside knob 28 can shift axially an appreciable amount.

Figure 8:
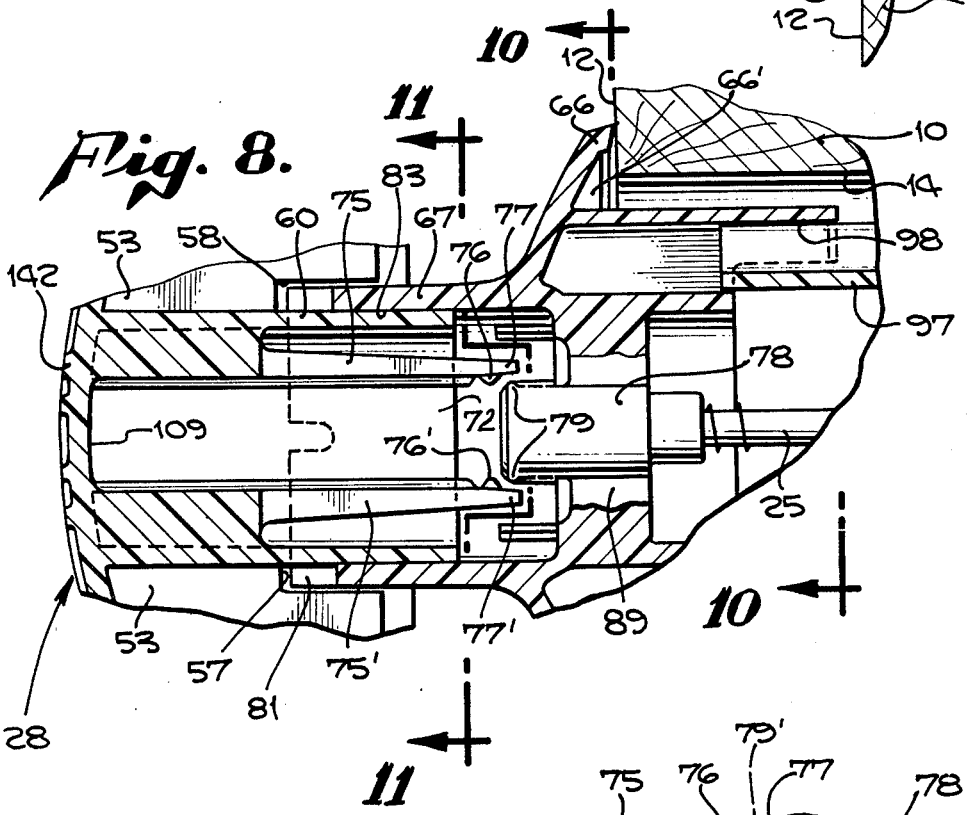
FIG. 8 is a longitudinal sectional view of the inside locking assembly on the line 8—8 of FIG. 7.
Figure 9:
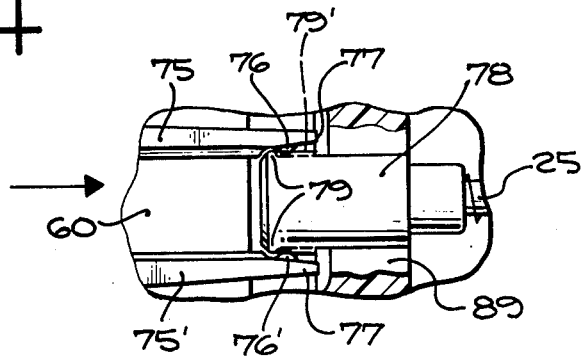
FIG. 9 is a fragmentary longitudinal section view of the inside locking assembly parts in locked position.
Figure 11:
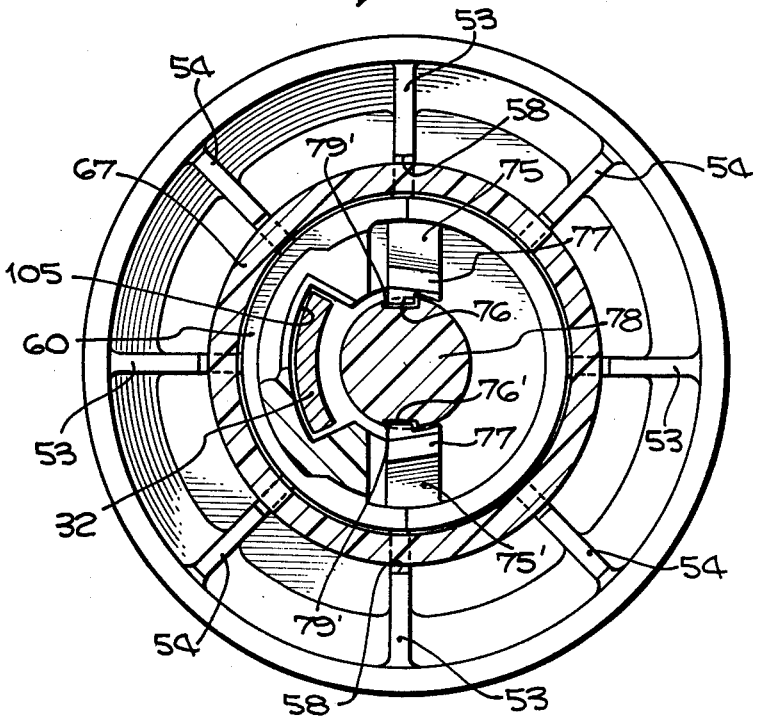
FIG. 11 is a cross-sectional view on the line 11—11 of FIG. 8 but with the knob pushed to locked position.
Figure 12:
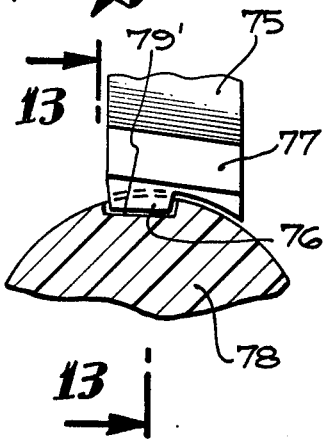
FIG. 12 is a fragmentary enlarged cross-sectional view of a privacy lock form of the device showing the locking detent.

Also on the inside knob 28 are locking legs 75 and 75' best shown in FIGS. 8, 9, and 11. The locking legs 75 and 75' are resilient and have at their respective inner ends beads 76 and 76' separated axially in one direction from respective ends 77 and 77'. The beads 76 and 76' are adapted to slide over a boss 78 and enter respective channels 79' behind the corresponding locking lugs 79 in an inwardly extended locked position of the inner knob 28, as shown in FIG. 9.

Figure 7:
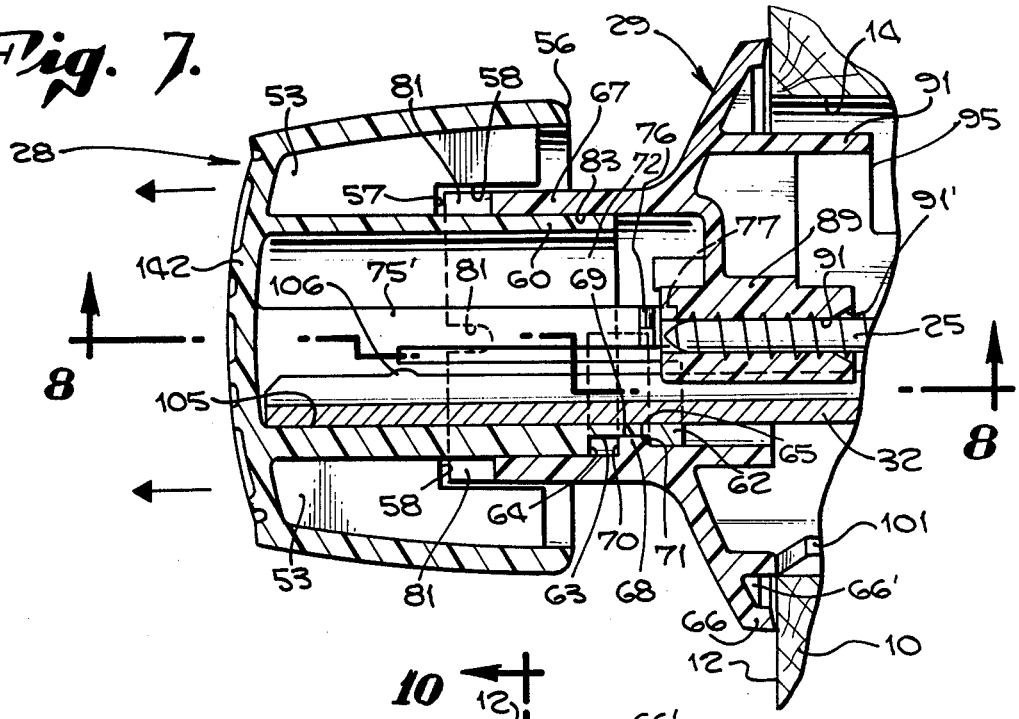
FIG. 7 is a longitudinal sectional view of the inside locking assembly in unlocked position of the push-to-lock form of the device.

To understand the locking arrangement reference is made to FIGS. 3 and 7 of the drawings where there is shown a series of circumferentially spaced axially inwardly extending notches or slots 81 at the edge of the bearing sleeve 67. Those portions of the fins 53 at the bottoms of the recesses 57 of the inside knob are adapted to project into the respective notches 81, when the inner knob 28 is pushed inwardly to the position shown in FIG. 9. By having the sleeve-like protruberances 60 slide snuggly within the interior bore 83 of the bearing sleeve 67 the locking beads 76, 76' are effectively centered with a minimum amount of wear.

The interlocking relationship locks the inner knob against rotation. When the inner knob is projected inwardly from the position of FIG. 8 to the position of FIG. 9, the beads 76 and 76' are flexibly deflected by the locking lugs 79 until they override the locking lug and are releasably detained in the inwardly extended position, namely the position in which the respective fins 53 are in the notches 81. In addition the sleeve 60 has a semicircular segment 72, the edges of which must align with corresponding edges of the arcuate boss 68 before the fins 53 can enter the notches 81. The breadth of the recess 63 is made such that it will accommodate an axial movement sufficient to accomplish the locking just described.

Conversely when the inner knob is to be unlocked it is merely pulled outwardly during which movement the beads 76 and 76' are again deflected over the locking lugs 79 from the position of FIG. 9 to the position of FIG. 8 wherein the fins 53 and segment 72 are disengaged. In the outer position of FIG. 8 the inner knob is still in rotatable engagement with the inside rose 29 by reason of the sliding fit of the protruberance 60 in the bearing sleeve 67.

In unlocked position ends of the fingers beyond the beads 76, 76' overlie the annular locking lug 79 so that when the knob is pushed upon the fingers 75, 75' do not hang up and cause the fingers to buckle.

For anchoring the two roses in position on the door and engagement with each other there is only the single screw 25 already identified. In the outside knob there is a central passageway 85 larger in diameter than the head of the screw to which access is had for a screw driver through a hole 86 in an end wall 87 of the outside knob. The hole 86 is preferably smaller than the head of the screw.

In the mass 51 of the outside rose there is a passageway 88 in axial alignment with the passageway 85 having a diameter large enough to snuggly accommodate the screw. A web or protrusion of material in the passageway 88 (not shown) may be employed to temporarily hold the screw 25 out of engagement with, but in alignment with, a screw hole 90 in a mass 89 of the inside rose 29. A flared opening 91' serves to direct the screw 25 into the hole 89. The screw hole 90 is small enough so that a thread forming screw like the screw 25 can be employed to thread its way into the screw hole 90 to hold the parts together. By making the hole 86 smaller than the head of the screw the screw can not fall out and get lost. The two subassemblies are attached together in this fashion and at the same time the parts are fastened in position on the door.

Figure 10:
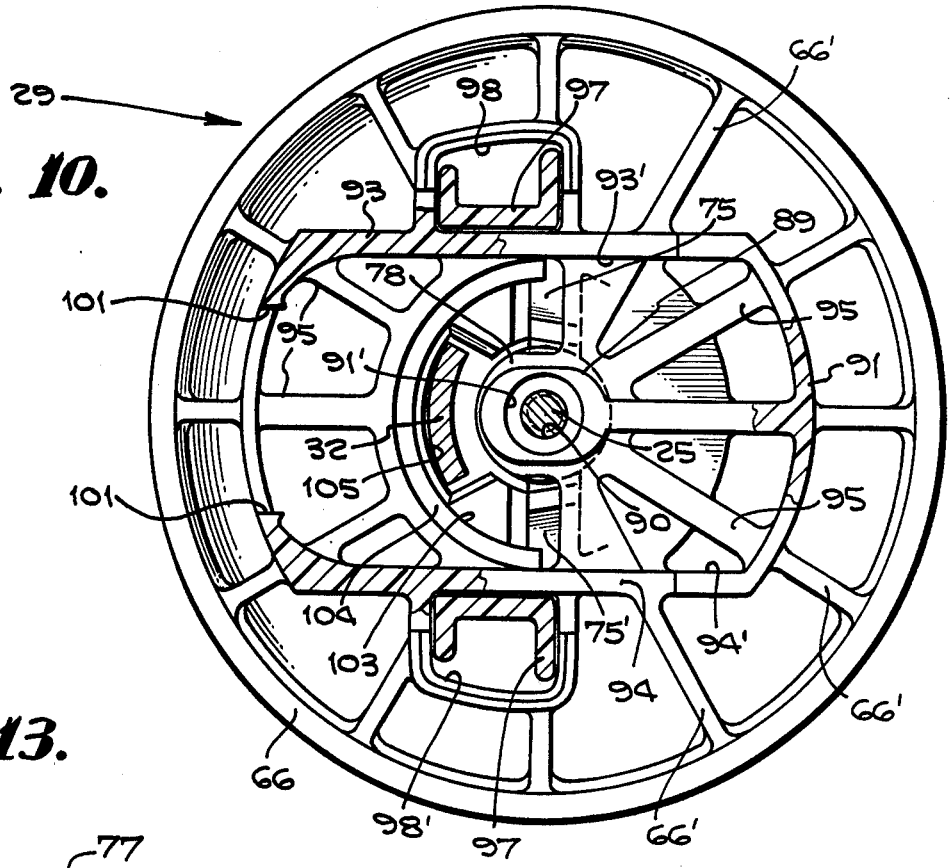
FIG. 10 is a cross-sectional view on the line 10—10 of FIG. 8.
Figure 13:
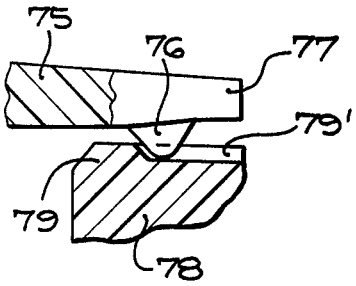
FIG. 13 is a longitudinal sectional view on the line 13—13 of FIG. 12.

There is appreciable reinforcing structure forming part of the inside rose 29 embodied in arcuate walls 91 and 92 and straight walls 93 and 94 as shown advantageously in FIG. 10. Surfaces 93' and 94' on the respective walls 93, 94 slidably accommodate the corresponding arms 112 and 113 of the latch bolt 31. Circumferentially spaced radially extending fins 95 interconnect the walls 91, 92, 93 and 94 with the mass 89. Other circumferentially spaced and radially extending fins 66' interconnect the walls 91, 92, 93, and 94 with the rim 66 of the inside rose, as shown in FIG. 10. Edges 101 of the wall 92 engage slots 102 in the latch bolt case 30 to hold parts together. A dove tail fit as shown inhibits disengagement.

An arcuately extending space 103 formed in part by a wall section 104 of the inside rose provides for rotation of the spindle 32.

To prevent the inside rose 29 from rotating relative to the outside rose 27 after they have been anchored in position as previously described channel sections 97 and 97' are provided on the outside rose 27 and these are adapted to be received in respective complementary pockets 98 and 98' on the inside rose. Further still to center the inside rose in the opening 14 in the door and by this center of the entire assembly, outside surfaces of the pockets 98 and 98' and the arcuate walls 91 and 92 have substantially the same curvature as the opening 14.

To accommodate the spindle 32 there is provided in the inside knob 28 an arcuate pocket 105 which has a cross sectional area and size complementary with respect to the cross sectional area and size of the spindle 32. The spindle is additionally provided with a pair of projections 106 which establish a frictional engagement with the walls of the arcuate pocket so that once the spindle has been pushed into position in the inside knob it will not readily fall out. Similarly the outside knob 26 is provided with an arcuate pocket 107 into which the outside end of the spindle 32 can freely enter. The spindle is of such length that one end 108 bottoms against an end wall 109 of the inside knob. No attempt is made to have the opposite end of the spindle bottom against the end wall 87 of the outside knob 26 because when doors of different thickness are encountered the position of the spindle 32 in the arcuate pocket 107 changes. When the knobs are interconnected by the spindle 32 as described both rotate simultaneously when one or the other is rotated.

Figure 14:
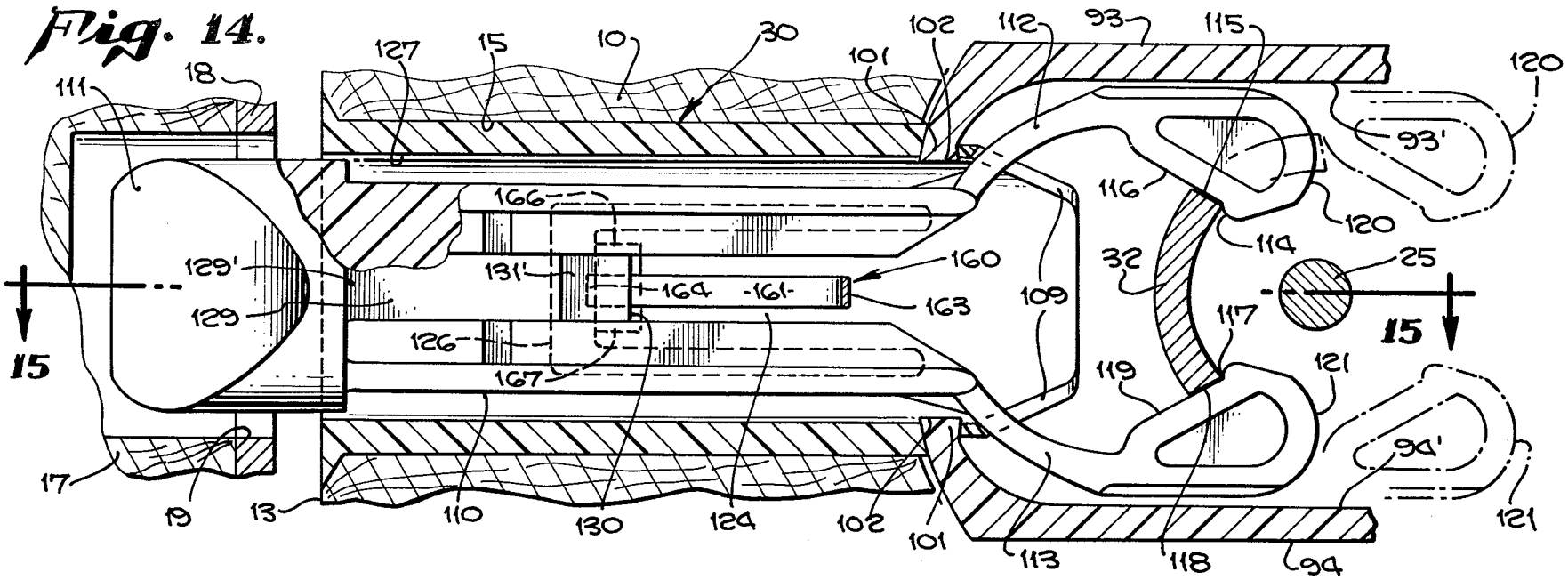
FIG. 14 is a longitudinal sectional view of the latch bolt sub-assembly in extended position on the line 14—14 of FIG. 2.

In essence rotation of the knobs is for the purpose of withdrawing the latch bolt 31 and thereafter permitting it to return to extended position. The latch bolt is specially constructed for this purpose. As shown in FIGS. 3, 14, and 17 the latch bolt consists of a shaft member 110 at one end of which is the latch bolt head 111 of customary design. The other end of the shaft 110 is bifurcated to provide a pair of resilient arms or bolt tails 112 and 113. The resilient arm 112 has a shoulder 114 facing the spindle 32 at an adjacent edge 115. Adjacent the shoulder 114 is an oblique camway 116 along which the edge 115 of the spindle is adapted to travel. Similarly on the resilient arm 113 is a shoulder 117 adjacent an opposite parallel edge 118 in the spindle 32 with a similar camway 119 along which the edge 118 is adapted to travel. When the spindle is rotated by operation of one or the other of the knobs from the position of FIG. 15 to the position of FIG. 16 the latch bolt head 111 is withdrawn subject to subsequent extension by appropriate spring action.

It should be noted, however, that ends 120 and 121 of the respective resilient arms are spaced wide apart and do not encompass the screw 25 except at the innermost extension of the latch bolt as shown by the broken lines in FIG. 14. Notches 109 in the case 30 receive arms 112, 113 when the latch bolt shaft is extended.

As shown in FIG. 17 there is sufficient clearance between the arms 112 and 113 to permit them to be forced together close enough to permit the latch bolt to be passed through the door edge bore 15 of substantially minimum diameter. To adequately confine and position the arms 112 and 113 the outside surfaces are made to slide along complementary surfaces 93' and 94' respectively of the walls 93 and 94, see FIG. 14.

To provide the necessary spring action to return the latch bolt to extended position there are provided on the case 30 a pair of spring legs 123 and 124. These spring legs are made of the same material as the case 30 and are in effect cut out of the wall of the case. The legs terminating respectively in free ends 125 and 126 extend inwardly into a guide bore 127 of the case, see FIG. 3. Immediately at the rear of the bolt head 111 there are two ramps 128 and 129 back to back which converge to an inner end 130.

Although a separate spring element 160 is shown the legs 123, 124 may be effectively employed to extend the shaft without assistance of the spring element 160.

When the spring element 160 is not employed the end 125 of the spring leg 123 is adapted to ride on the ramp 128 and the end 126 of the spring leg 124 is adapted to ride on the leg 129. There is additionally provided ramps 131 and 131' at a steeper angle adjacent the inner end 130 which serve to more effectively build up spring tension during initial withdrawing movement of the latch bolt 111. This compensates for a diminishing effectiveness of the spring legs 123 and 124 as they approach their relaxed position with the shaft fully extended.

A shoulder 129' at the head end of the ramp 129 by engagement with the end of the respective finger 124 prevents inadvertent disassembly of the shaft member 110 from the case 30.

When the latch bolt including the latch bolt head is withdrawn by rotation of the spindle the ends 125 and 126 slide up the respective ramps 128 and 129 building up tension in the spring legs 123 and 124 as they approach opposite ends of the ramps. When the spindle is released energy built up in the spring legs causes them to press against the respective ramps and by this pressing or squeezing action to extend the latch bolt head outwardly again to the position shown in FIGS. 21 and 22.

Occasions may arise when a stronger spring action is desirable to extend the latch bolt shaft or for example, to return the knobs to initial position after they have been rotated to withdraw the latch bolt. The spring element 160 serves this purpose. In a modified U shape spring legs 161 and 162 are joined at one end by a transverse portion 163. The opposite free end of leg 161 has a foot 164 and the leg 162 a foot 165. The spring element is inherently biased so that the feet 164 and 165 are pressed together with an appropriate amount of spring tension.

Figure 15:
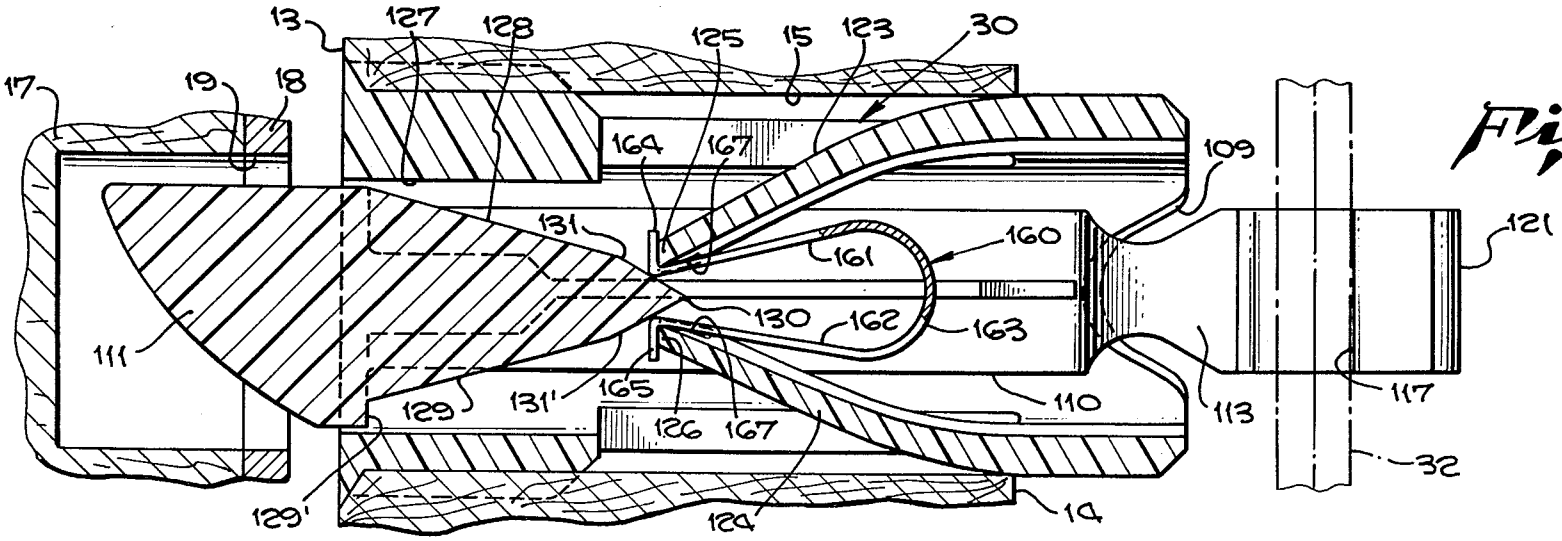
FIG. 15 is a longitudinal sectional view on the line 15—15 of FIG. 14.
Figure 16:
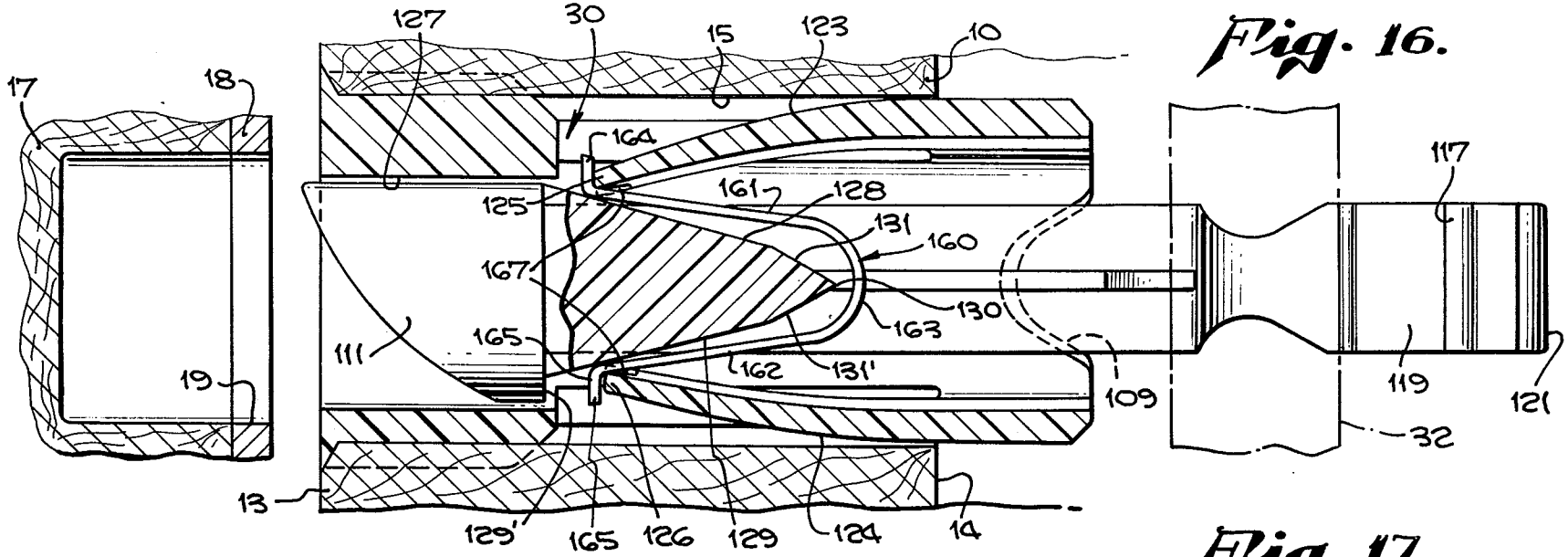
FIG. 16 is a longitudinal sectional view similar to FIG. 15 but in retracted position.
Figure 17:
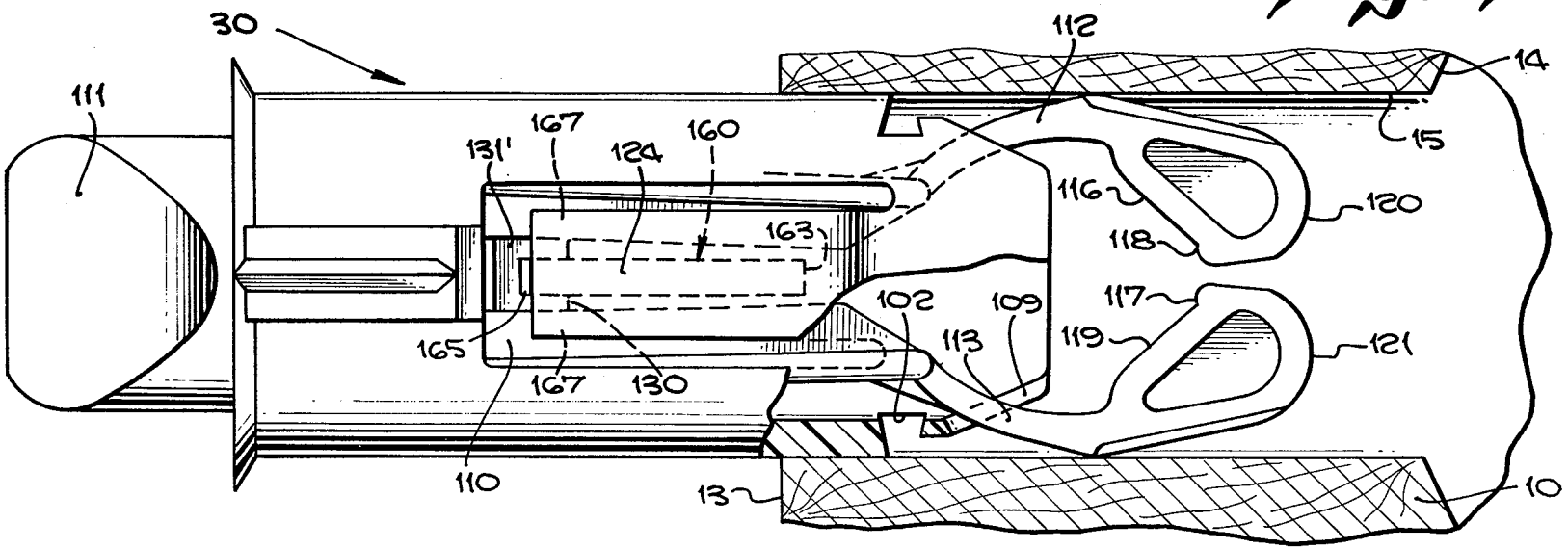
FIG. 17 is a longitudinal sectional view of the latch bolt sub-assembly during insertion into the door.

Positioned as shown in FIGS. 15 and 16 the end 125 of the leg 123 is lodged in the angle formed by the foot 164 with the corresponding spring leg 161. The end 126 is similarly lodged behind the foot 165. As a consequence when one or the other of the knobs are rotated to withdraw the latch bolt from the position of FIG. 15 to the position of FIG. 16 there is greater resistance to rotation offered by the combined spring tension of two legs 123, 124 together with the spring legs 161 and 162. This greater spring tension is available to subsequently return the knobs to initial position and to extend the latch bolt.

Although a spring element may have various effective shapes for supplementing action of the legs 123 and 124, a single piece U shaped element is especially advantageous. When assembled in the latch bolt case the spring element is preferably inserted in the orientation shown in FIG. 3 into the space between the resilient areas 112, 113 until the feet 164, 165 engage the corresponding ramps of the shaft 110. Then when the shaft is projected into the case 30 the ends of the legs 123, 124 snap over the feet and the spring element becomes locked in as shown in FIG. 15. In this form of the device the material of the spring element 160 actually engages the ramps rather than the material of the legs. Otherwise action of the legs is the same as has been initially discribed.

Although a metal spring element 160 has been shown for the purpose of illustration other spring material may be employed such as an appropriate synthetic plastic resin, with or without reinforcement. A desired tension may be built into the spring element depending on desirable performance requirements of the latch.

To prevent ends of the spring legs from shifting laterally, tear drop projections 166 and 167 may be formed at respective ends of the legs 125 and 124 providing a space between the projections 166, 167 for accommodation of the ends of the spring legs.

For locking the plastic lock when it is structured as a privacy lock as described in detail, locking is accomplished when the spindle is locked against rotation. To so lock the spindle the inside knob 28 is pushed inwardly as has been previously described. Should the door be inadvertently locked when in the open position no damage is done to the lock set should the door be closed and the latch bolt be driven back because movement of the arms 112 and 113 will not be impaired by either the spindle 32 or the screw 25.

For unlocking the lockset from the outside of the door, more commonly known as emergency release, there is provided an opening 135 in the end wall 87 of the outside knob 26, the opening being in alignment with the spindle 32. An appropriate tool such, for example, as a rod 136 can be inserted through the opening 135 and pressed against an adjacent end edge 137 of the spindle 32 which in turn pushes against the end wall 109 of the inside knob 28 causing the beads 76 and 76' to be disengaged from the annular lock lugs 79 at which time the fins 53 are disengaged from the notches or slots 81, and the segment 72 is disengaged from the edges of the arcuate boss 68. As a result the inside knob 28, and the outside knob 26 as well, are then free to be rotated for withdrawal of the latch bolt. A slot 134 in the inner sleeve 41 serves to guide the rod 136 as it is pushed against the spindle 32 and a step 138 in the end edge of the spindle also helps center the rod 136 in alignment with the spindle.

Figure 4:
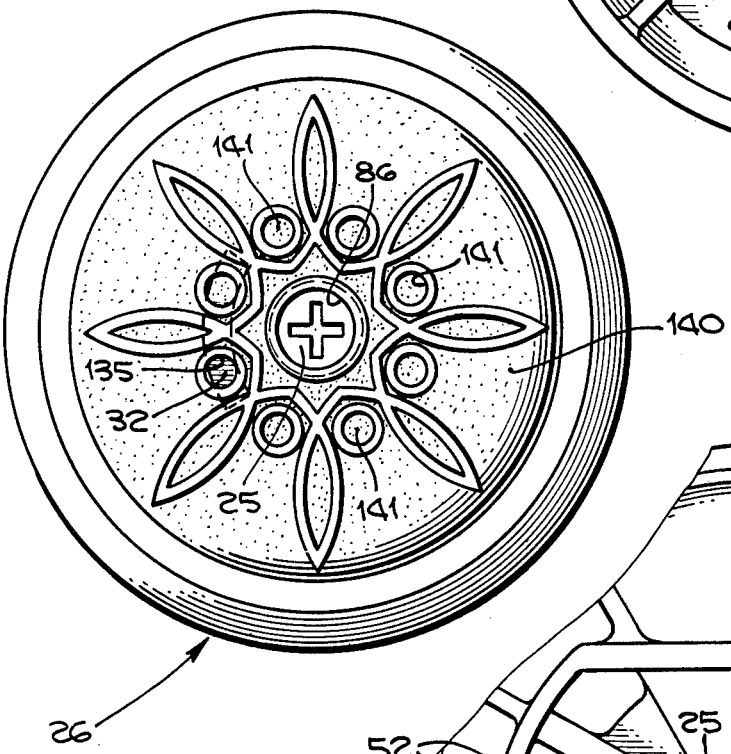
FIG. 4 is a right end elevational view on the line 4—4 of FIG. 2.
Figure 6:
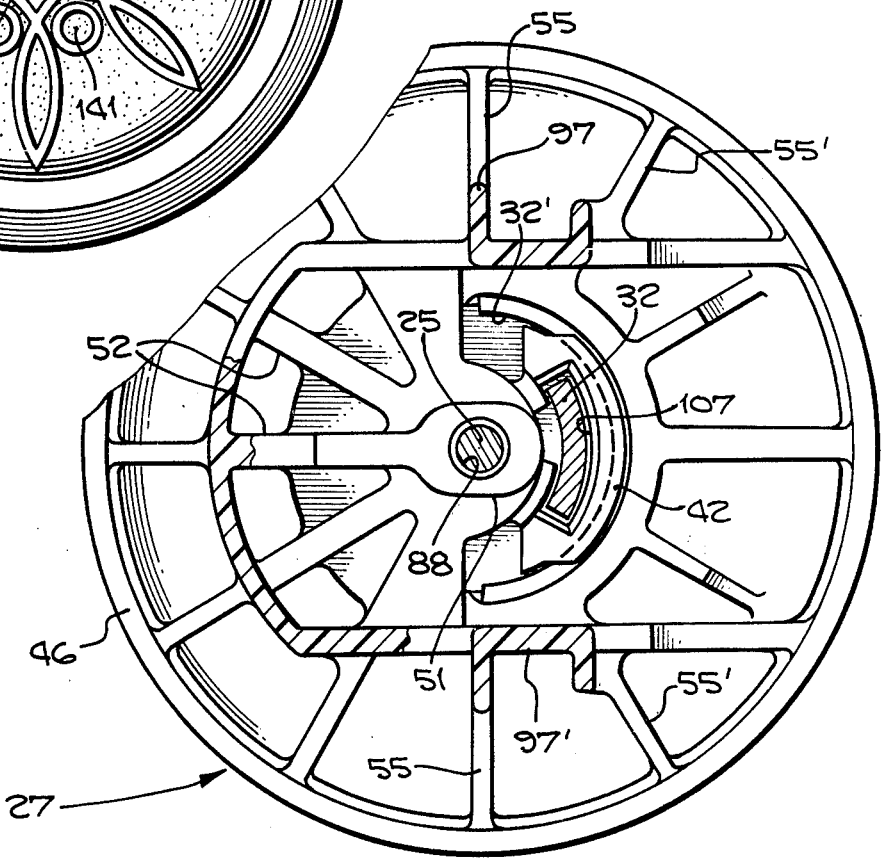
FIG. 6 is a cross-sectional view on the line 6—6 of FIG. 2.

As shown in FIG. 4 an end face 140 of the outside knob 26 can be provided with a design presenting a series of blind recesses 141 which are similar in appearance to the opening 135. Sundry varied designs may be selected. An end face 142 of the inside knob 28 may carry a comparable design.

Prior to assembly of the outside rose and knob with the inside rose and knob on the door the latch bolt is inserted. The spindle then is projected into the space between the resilient arms 112 and 113 of the latch bolt. The case 30 is effectively interlocked with the other working parts and secured in the appropriate rose in the door by interlocking dovetail edges 101 of the rose 29 with the dovetail slots 102 of the case 30. It follows, therefore, that all of the component parts are attached to each other and in proper position on the door in a quick, single operation by merely assembling them in position in the door and then securing them by employment of a single screw.

In each instance the knob, whether outside or inside knob, may be preassembled on the corresponding rose in a manner permitting disassembly whenever necessary.

Having described the invention what is claimed as new in support of Letters Patent is as follows:

1. A latch bolt sub-assembly for operation with a spindle having edge means rotatable about an axis of rotation, said sub-assembly comprising a tubular case member of synthetic plastic resin material having an outwardly facing opening, an inwardly facing opening, and a cylindrical guide bore therethrough between said openings, and a latch bolt member having a shaft slidably mounted in said case member, said shaft having roll back means at one end for engagement by the spindle and a latch bolt head at the other end, said latch bolt member comprising a cam track having an incline relative to the long axis of the latch bolt member extending from the bolt head radially inwardly toward the long axis of the latch bolt member, said tubular case member having resilient finger means comprising a cut out portion of the wall of said case member with one end anchored and an opposite free end extending toward said outwardly facing opening and biased normally into the interior of said case member and in sliding engagement with said cam track, whereby to provide a resilient force acting in a direction urging said shaft to an extended position.

2. A latch bolt sub-assembly as in claim 1 wherein said cam track has a main portion adjacent the latch bolt head at one inclination and another portion at a different inclination whereby to vary the resilient force applicable at different positions of retraction of the shaft.

3. A latch bolt sub-assembly as in claim 1 wherein there are complementary shoulders respectively on said shaft and said finger means forming an engagement between the shaft and the finger means at full withdrawn position of the shaft to prevent inadvertent disassembly of the latch bolt member from the case member.

4. A latch bolt sub-assembly as in claim 1 wherein there are two cam tracks on diametrically opposite sides of the respective member and a corresponding finger means for each cam track.

5. A latch bolt sub-assembly as in claim 4 wherein said roll back means comprises diametricaly opposite bolt tails of resilient yieldable character each having one end anchored on the latch bolt member, a shoulder on the other end for roll back engagement with a respective edge of said spindle, and an inclined cam way adjoining each shoulder productive of a progressive sliding engagement with the respective edge of the spindle after said respective edge moves from engagement with the corresponding shoulder.

6. A latch bolt sub-assembly as in claim 5 for assembly through an edge bore of a door wherein said bolt tails have positions which when collapsed have said other ends spaced apart a distance no greater than about the outside diameter of said tubular case member whereby to enable insertion of said sub-assembly as a unit through said edge bore.

7. A latch bolt sub-assembly as in claim 5 wherein said bolt tails have positions which when collapsed provide a distance between said bolt tails at the widest point greater than the inside diameter of said tubular case member whereby to lock the latch bolt shaft against removal through said outwardly facing opening.

8. A latch bolt sub-assembly as in claim 1 wherein the bolt head has a diameter no greater than the guide bore and wherein the cam track extends from the latch bolt in an inclined direction radially inwardly toward the long axis of the latch bolt member, whereby to enable insertion of the latch bolt member with the bolt head first through the rearwardly facing opening into said guide bore.

9. A latch bolt sub-assembly as in claim 1 wherein the tubular case has a cylindrical wall section of uniform thickness and a cylindrical guide bore therethrough between said openings, said resilient fingers having a thickness substantially the same as the thickness of said cylindrical wall section.

10. A latch bolt sub-assembly for operation with a spindle having edge means rotatable about an axis of rotation said, sub-assembly comprising a tubular case member having an outwardly facing opening and an inwardly facing opening and a latch bolt member having a shaft slidably mounted in said case member, said shaft having roll back means at one end for engagement by the spindle and a latch bolt head at the other end, one of said members comprising a cam track having an incline relative to the long axis of the latch bolt member, the other of said members having resilient finger means of synthetic plastic resin material with one end anchored and an opposite free end in sliding engagement with said cam track, whereby to provide a resilient force acting in a direction urging said shaft to an extended position, and an auxiliary spring element having one portion anchored between the cam track and the free end of the finger means, another portion of said auxiliary spring element having a spring kept engagement with said case member.

11. A latch bolt sub-assembly for operation with a spindle having edge means rotatable about an axis of rotation, said sub-assembly comprising a tubular case member of synthetic plastic resin material having an outwardly facing opening and an inwardly facing opening and a latch bolt member having a shaft slidably mounted in said case member, said shaft having roll back means at one end for engagement by the spindle and a latch bolt head at the other end, said latch bolt member comprising a cam track having an incline relative to the long axis of the latch bolt member, said tubular case member having resilient finger means comprising a portion of the wall of said case member with one end anchored and an opposite free end biased normally into the interior of said case member and in sliding engagement with said cam track, whereby to provide a resilient force acting in a direction urging said shaft to an extended position wherein there are two cam tracks on diametrically opposite sides of the respective member and a corresponding finger means for each cam track there being a generally U shaped auxiliary spring element having a free end of one leg of the spring element anchored between one cam track and the corresponding free end of the finger means and a free end of the other leg of the spring element anchored between the other cam track and the corresponding free end of the other finger means.

12. A latch bolt sub-assembly as in claim 11 wherein a portion of the spring element interconnecting said legs is lodged within the case member and between said finger means.

13. A latch bolt sub-assembly as in claim 11 wherein said spring element is a single piece of metallic leaf spring material.

* * * * *